United States Patent [19]

Tinti

[11] Patent Number: 4,710,097

[45] Date of Patent: Dec. 1, 1987

[54] STATOR ASSEMBLY FOR GAS TURBINE ENGINE

[75] Inventor: Aldo A. Tinti, Fairfield, Conn.

[73] Assignee: Avco Corporation, Providence, R.I.

[21] Appl. No.: 867,163

[22] Filed: May 27, 1986

[51] Int. Cl.[4] ..... F04D 29/34

[52] U.S. Cl. ..... 415/138; 415/190; 415/217

[58] Field of Search ..... 415/137, 138, 139, 189, 415/190, 216, 217, 218, 200

[56] References Cited

U.S. PATENT DOCUMENTS

| | | | |
|---|---|---|---|
| 2,755,064 | 7/1956 | Simonsen | 415/216 X |
| 2,763,462 | 9/1956 | McDowall et al. | 415/217 X |
| 2,957,228 | 10/1960 | Stoddard et al. | 415/217 X |
| 4,295,785 | 10/1981 | Lardellier | 415/217 X |

FOREIGN PATENT DOCUMENTS

| | | | |
|---|---|---|---|
| 891422 | 3/1944 | France | 415/217 |
| 964211 | 8/1950 | France | 415/217 |
| 67806 | 6/1977 | Japan | 415/189 |

*Primary Examiner*—Robert E. Garrett
*Assistant Examiner*—Joseph M. Pitko
*Attorney, Agent, or Firm*—Perman & Green

[57] ABSTRACT

A stator assembly for a gas turbine engine is provided having novel means for securing it to the casing of the engine's compressor section. The stator assembly includes inner and outer shrouds secured, as by brazing, to a plurality of vanes and also includes a plurality of vane assemblies for clamping the shrouds and associated vanes to the casing of the compressor section. The vane of each vane assembly projects through but is not secured to the shrouds, the inner end of each vane of the vane assemblies having an integral plate engaging the interior of the inner shroud and means at its outer end for fastening the vane assembly to the casing by drawing the plate firmly into compression against the interior of the inner shroud. Since the vane assemblies are not secured to the shrouds, expansion of the casing during engine operation can be accommodated without imposing any destructive stresses on the shrouds, thereby protecting the structural integrity of the engine.

14 Claims, 3 Drawing Figures

STATOR ASSEMBLY FOR GAS TURBINE ENGINE

BACKGROUND OF THE INVENTION

Stators for gas turbine engines typically comprise a brazed assembly of vanes, an inner shroud, and an outer shroud which is directly bolted to the outer casing of the engine. In prior art stator assemblies, threaded bosses, brazed directly to the exterior of the outer shroud, are engaged by bolts tightened securely against the outside wall of the casing. As the engine heats up during operation, the casing expands more rapidly than the stator assembly, thereby generating substantial stresses in the outer shroud vane interface in the region immediately adjacent the bosses. Experience has shown that the stresses may be so great that the vane at the outer shroud is cracked, endangering the structural integrity of the engine.

The present invention comprises means for attaching stator assemblies to the engine's casing without imposing stresses on the outer shrouds, thereby avoiding failures of the type encountered in prior art installations.

SUMMARY OF THE INVENTION

The preferred embodiment of the present invention provides a stator assembly having a plurality of vanes secured to the inner and outer shrouds and, in addition, a plurality of vane assemblies that are not secured to the shrouds yet hold them in firm clamped engagement with the outer casing of the engine. Each of the vane assemblies comprises a vane, extending loosely through the shrouds, with a plate at its inner end positioned to fit within the inner shroud, and a fastener at its outer end for securing the assembly to the casing. As it is tightened, the fastener, which may be a stud projecting through a hole in the casing, draws its associated vane towards the casing, bringing the plate into bearing engagement with the inner shroud. In effect, the plate clamps the inner shroud and the rest of the stator assembly to the casing. Since no forces are transferred to the outer shroud, no stresses are generated within it, and cracking of the vane at the outer shroud is avoided despite expansion of the casing during operation of the engine.

DESCRIPTION OF THE DRAWINGS

The invention is described in more detail below with particular reference to the attached drawings in which.

DESCRIPTION OF THE STATOR ASSEMBLY

Figure 1:
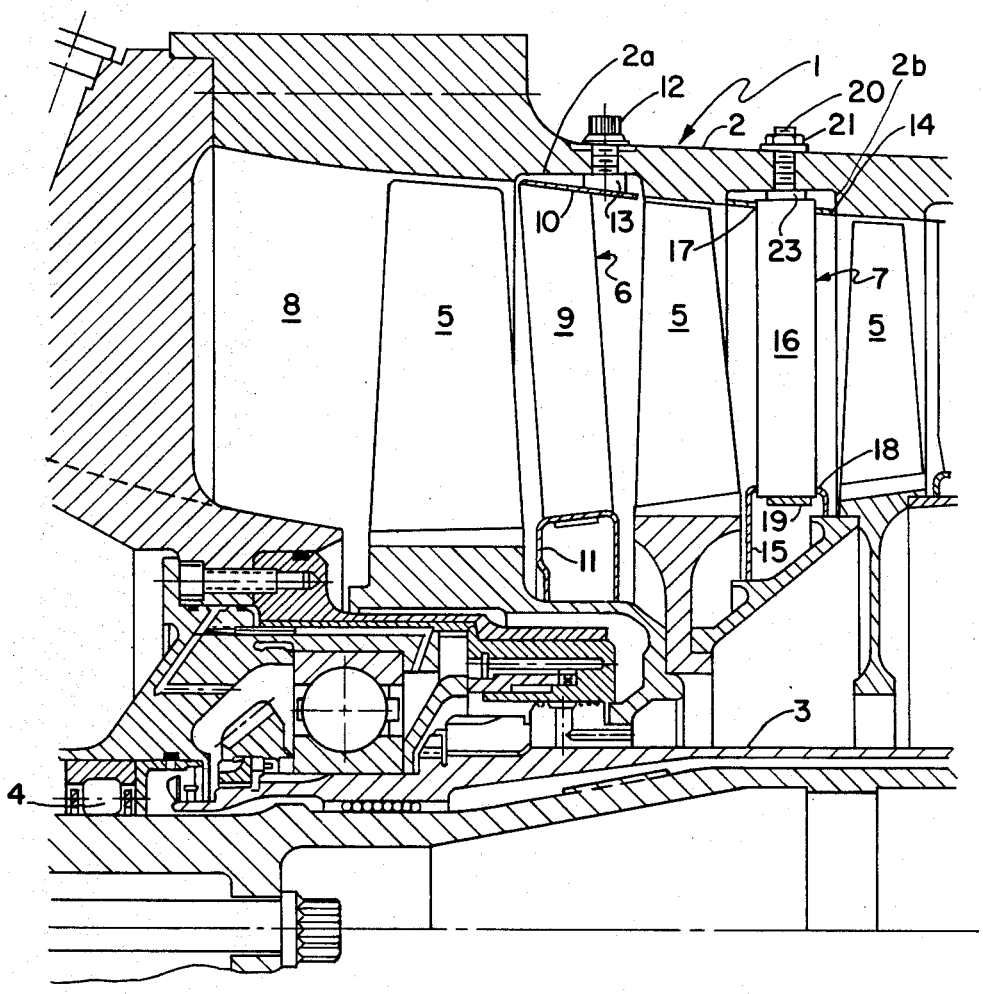
FIG. 1 is a cross sectional view of the compressor section of a gas turbine engine showing the construction of both prior art stator assemblies and those employing the principles of the present invention.

Referring first to FIG. 1, there is shown a portion of the compressor section of a gas turbine engine, generally designated 1. The compressor section comprises an outer casing 2 surrounding a compressor shaft 3 rotatably supported by bearing 4 mounted on the casing. Secured to the compressor shaft 3 is a plurality of compressor blades 5 which rotate with the shaft 3 between stator assemblies, generally designated 6 and 7, the stator assemblies being secured to casing 2 as will be explained. In a manner that is well-known in the art, the casing 2, as well as the stator assemblies 6 and 7, are assembled in halves which are bolted together around the compressor shaft and its associated compressor blades.

Air for the gas turbine engine enters through inlet vanes 8, is compressed by the first stage of rotating compressor blades 5, the air stream then passing through stator assembly 6 which directs the air to the second stage of compressor blades, as is well-known in the art. Thereafter, the air stream is directed by stator assembly 7 to the next stage of compressor blades, the air stream eventually being directed to the combustor section and turbine section (not shown) of the engine which generates the power for driving the compressor shaft and the device to which the engine is connected.

Prior Art Stator Assembly

Directing attention to stator assembly 6, there is shown the construction employed in prior art engines. The stator assembly comprises a plurality of vanes 9, furnace-brazed to an outer shroud 10 and an inner shroud 11, making a unitary structure. The structure, built in two sections as has been explained, fits within circular groove 2*a* of casing 2 and is secured to it by bolts 12 which pass through the casing and threadedly engage a plurality of bosses 13 brazed at intervals to the exterior of the outer shroud 10.

Typically, the casing 2 is made from magnesium and the components of the stator assembly from high-strength stainless steel. Since magnesium has a coefficient of thermal expansion greater than that of stainless steel, the casing, which heats up during the time that the engine is operating, expands more than the stator assembly. Such differential expansion generates stresses in the outer shroud 10 adjacent bosses 13 which may lead to cracking of the vane at the outer shroud and eventually to engine failure.

Improved Stator Assembly

The shortcomings of prior art stators are eliminated by stator assemblies built according to the teachings of the present invention. Attention is now directed to stator assembly 7. In that preferred embodiment of the invention, a plurality of vanes are brazed to outer and inner shrouds 14 and 15, respectively as in the prior art. However, interspersed between those vanes is a plurality of vane assemblies for clamping the stator assembly to the casing 2. Depending upon the engine's size, from four to eight vane assemblies may be employed in each half of the stator assembly.

Figure 2:
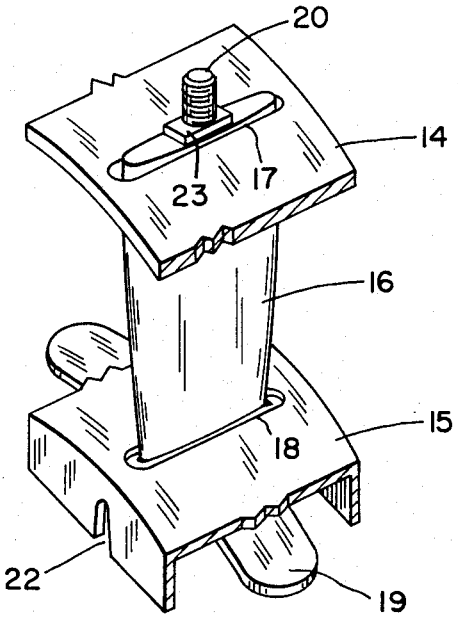
FIG. 2 is a perspective view of a vane assembly used to clamp the novel stator assembly of the present invention to the casing of the compressor section.

As shown in FIG. 2, each vane assembly comprises a vane 16 which passes through outer shroud 14 and inner shroud 15 with close clearance, as at 17 and 18, respectively. Secured, as by brazing, to the inner end of vane 16 is a plate 19, bearing against the interior of inner shroud 15, and a fastener 20 to its outer end. In the preferred embodiment, the fasteners is a threaded stud which projects through casing 2 and is engaged by nut 21. Instead of a stud, a threaded boss (not shown) may be secured to the outer end of the vane and engaged by a bolt passing through the casing. As nut 21 is tightened, the vane is gradually placed in tension as plate 19 comes into compression against the interior of the inner shroud. In this way, the stator assembly as a whole is clamped to the casing 2. Because no forces are applied to the outer shroud, no stresses are generated in it and all danger of cracking is eliminated. As the magnesium casing expands during engine operation, as has been explained, the forces clamping the stator assembly to the casing are increased further, enhancing the stability of the entire structure by reducing axial deflection of the inner shroud.

In some engines, it may be desirable to limit the buildup of stresses in the inner shroud. Should that be deemed appropriate, a notch 22 may be cut in the inner shroud adjacent each plate 19. Further, the amount of tension in vane 16 can be limited by providing at the outer end of the vane a pad 23 which comes into bearing engagement with the casing as nut 21 is tightened (See FIG. 1). However, the vane assembly must be proportioned so that plate 19 bears securely against the inner shroud before the pad 23 engages the casing.

Figure 3:
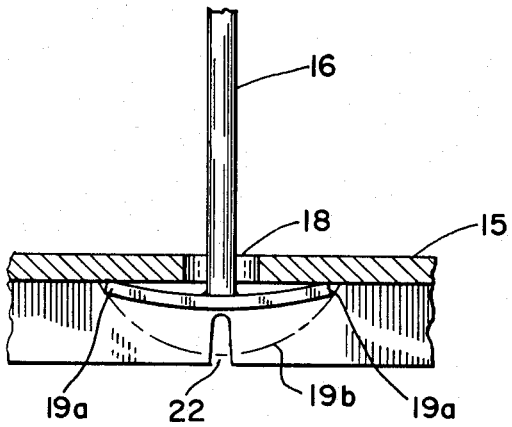
FIG. 3 is an enlarged cross sectional view of the inner end of a vane assembly in engagement with the inner shroud of the stator assembly.

Although plate 19 may be shaped to conform to the interior surface of the inner shroud, tightening of the vane assembly to the casing 2 can be made less critical if the plate is dished away from the interior surface as shown in FIG. 3. When that configuration is employed, ends 19*a* of the plate first come into bearing engagement with the inner shroud. As nut 21 is tightened, tension forces in the vane gradually increase thereby flattening the plate in compression against the shroud.

If notches 22 are employed to relieve stresses in the inner shroud, there is the possibility of leakage of compressed air through the notches from one side of the stator assembly to the other. To prevent such leakage, a skirt 19*b* (shown as broken dash lines in FIG. 3) may be added to plate 19 proportioned to block off each notch.

Assembly Procedure

When the stator assembly is to be mounted within the casing, each half of the assembly is first positioned within a circular groove 2b formed on the interior of the one half of the casing. When it is properly positioned, each vane assembly is slid radially through the inner shroud and then through the outer shroud until its fastener is positioned to be secured from outside the casing. After each vane assembly has been secured in position, as by tightening nut 21, the casing with stator assemblies attached can be joined to form a closed assembly around the compressor shaft and associated blades.

CONCLUSION

From the foregoing description of the preferred embodiment of the invention, it will be understood that it provides an improved stator assembly that can be easily mounted within a gas turbine engine without danger of generating stresses endangering the engine while in operation.

According to the above description, the following invention is claimed as novel and is desired to be secured by Letters Patent of the United States.

I claim:

1. A gas turbine engine having a compressor section comprising:

an outer casing, said casing having a circular groove in its interior wall;

an outer shroud fitted within the groove of said outer casing;

an inner shroud;

a plurality of first a vane of a first vane type joined to said inner and said outer shrouds;

a vane assembly including a second vane of a second vane type disposed between said inner and outer shrouds, said second vane having inner and outer ends, with a fasteners secured to its outer end and a plate secured to its inner end, said fastener and the outer end of said second vane also projecting relatively loosely through said outer shroud, said second vane also projecting through said inner shroud with said plate clamping engagement with the interior of said inner shroud; and means engaging said fastener for securing said vane assembly to said outer casing.

2. A gas turbine engine as described in claim 1 further comprising:

a pad secured to said second vane of said vane assembly adjacent said fastener, said pad being positioned to bear against the interior of the groove of said outer casing as said engaging means is secured to said fastener.

3. A gas turbine engine as described in claim 2 in which portions of said plate are displaced towards said second vane of said vane assembly.

4. A stator assembly comprising:

an outer shroud;

an inner shroud;

a plurality of first vanes of a first vane type joined to said outer and inner shrouds; and a vane assembly having a second vane of a second vane type projecting through said outer and inner shrouds with a fastener joined to said second vane where it projects through said outer shroud and a plate joined to its end in position to engage the interior of said inner shroud, said second vane extending relatively adjustably through said outer shroud.

5. A stator assembly as described in claim 4 further comprising;

a pad secured to the end of said second vane between said second vane and said fastener.

6. A stator assembly as described in claim 5 in which said inner shroud has a notch adjacent said plate and said plate is formed to cover the notch.

7. A vane assembly for clamping a stator to the casing of a gas turbine engine, the stator comprising an outer shroud, an inner shroud, and a plurality of first vanes of a first vane type joined to said outer and inner shrouds, said vane assembly comprising:

a second vane of a second vane type having inner and outer ends, said inner and outer ends projecting through said inner and outer shrouds, respectively;

means integral with the outer end of said second vane for securing it to the casing of the gas turbine engine;

means integral with the inner end of said second vane for applying compression forces to a bottom surface of said inner shroud; and means for allowing said second vane to adjustably move relative to said outer shroud.

8. A vane assembly for clamping a stator to the casing of a gas turbine engine as described in claim 7 in which said first named means is a threaded stud.

9. A vane assembly for clamping a stator to the casing of a gas turbine engine as described in claim 8 in which said last named means is a plate conforming to the shape of said bottom surface.

10. A vane assembly for a gas turbine engine comprising:

a vane having inner and outer ends;

a pad integral with the outer end of said vane;

a stud integral with and extending outwardly from said pad; and a flexible compression plate integral with the inner end of said vane.

11. A vane assembly for a gas turbine engine as described in claim 10 in which portions of said plate are displaced towards the outer end of said vane.

12. A method of assembling a stator assembly to the casing of a gas turbine engine comprising the steps of:

providing the stator assembly with a plurality of first vanes of a first vane type each of which is fixedly attached at opposing ends thereof to an outer and an inner shroud;

providing the stator assembly with radially opposed pairs of openings made through the inner and outer shrouds;

providing openings through the casing;

positioning the stator assembly within a groove formed on an interior wall of the casing such that the openings made through the outer shroud and the openings made through the casing are in registration one with the other;

sliding a second vane of a second vane type radially through each of the pairs of openings of the inner and outer shrouds, the second vane having a fastening means provided on an outer end, the second vane further having a compression means provided on an inner end for compressively engaging a bottom surface of the inner shroud; and securing each of the second vanes to the casing with a securing means which tighteningly engages the fastening means through the corresponding opening within the casing such that the second vane is placed in tension whereby the compression means compressively engages the bottom surface of the inner shroud to clamp the stator assembly to the casing.

13. A method as defined in claim 12 wherein the fastening means is a threaded stud which projects through the opening of the casing and wherein the securing means is a nut which engages the stud.

14. A method as defined in claim 12 wherein the fastening means is a threaded boss and wherein the engaging means is a bolt which passes through the opening within the casing to engage the boss.

* * * * *